US010641089B2

(12) United States Patent
Santarelli

(10) Patent No.: US 10,641,089 B2
(45) Date of Patent: May 5, 2020

(54) DOWNHOLE PRESSURE MEASURING TOOL WITH A HIGH SAMPLING RATE

(71) Applicant: Geomec Engineering Ltd., London (GB)

(72) Inventor: Frederic Joseph Santarelli, Stavanger (NO)

(73) Assignee: GEOMEC ENGINEERING, LTD., London (GB)

( * ) Notice: Subject to any disclaimer, the term of this patent is extended or adjusted under 35 U.S.C. 154(b) by 0 days.

(21) Appl. No.: 15/574,695

(22) PCT Filed: Jun. 2, 2016

(86) PCT No.: PCT/GB2016/051625
§ 371 (c)(1),
(2) Date: Nov. 16, 2017

(87) PCT Pub. No.: WO2016/193733
PCT Pub. Date: Dec. 8, 2016

(65) Prior Publication Data

US 2018/0135395 A1 May 17, 2018

(30) Foreign Application Priority Data

Jun. 3, 2015 (GB) ..... 1509576.3
Jun. 3, 2015 (GB) ..... 1509579.7
Aug. 3, 2015 (GB) ..... 1513655.9

(51) Int. Cl.
*E21B 49/00* (2006.01)
*E21B 47/06* (2012.01)
(Continued)

(52) U.S. Cl.
CPC ..... *E21B 49/008* (2013.01); *E21B 43/26* (2013.01); *E21B 43/267* (2013.01); *E21B 47/06* (2013.01);
(Continued)

(58) Field of Classification Search
CPC ..... E21B 43/255; E21B 43/26; E21B 47/06; E21B 49/003; E21B 49/006; E21B 49/008
(Continued)

(56) References Cited

U.S. PATENT DOCUMENTS 2,952,449 A 9/1960 Bays
3,285,342 A 11/1966 Cronberger
(Continued)

FOREIGN PATENT DOCUMENTS

CA 2013726 A1 10/1990
CA 2240580 C 1/2001
(Continued)

OTHER PUBLICATIONS

EPO as Int'l Search Authority; International Search Report for PCT/GB2016/051621; dated Sep. 12, 2016; entire document; Rijswijk, The Netherlands.
(Continued)

*Primary Examiner* — Benjamin R Schmitt
(74) *Attorney, Agent, or Firm* — Law Office of Jesse D. Lambert, LLC

(57) ABSTRACT

A dynamic monitoring system for dynamically monitoring injection operations on wells by determining the extent of fracturing using downhole pressure measurements. The system comprises a downhole pressure gauge, means to transmit data from the downhole pressure gauge to the surface and a surface data acquisition unit wherein, on inducing a pressure change in a wellbore by an injection operation, the downhole pressure gauge records a pressure trace as data, the data is transmitted to the surface at a first sampling frequency, the data is stored in the surface data acquisition unit and fracture length is calculated from the stored data to
(Continued)

indicate extent of fracturing. Sampling frequencies are outside the known operating ranges.

20 Claims, 4 Drawing Sheets

(51) Int. Cl.
*E21B 43/26* (2006.01)
*E21B 43/267* (2006.01)
*E21B 33/12* (2006.01)
*E21B 43/11* (2006.01)
*E21B 43/14* (2006.01)

(52) U.S. Cl.
CPC ..... *E21B 47/065* (2013.01); *E21B 49/00* (2013.01); *E21B 33/12* (2013.01); *E21B 43/11* (2013.01); *E21B 43/14* (2013.01)

(58) Field of Classification Search
USPC ..... 73/152.39, 152.51, 152.52, 152.54
See application file for complete search history.

(56) References Cited

U.S. PATENT DOCUMENTS

| | | | | |
|---|---|---|---|---|
| 3,501,201 | A | 3/1970 | Clossman et al. | |
| 3,732,728 | A * | 5/1973 | Fitzpatrick | E21B 47/06 340/854.4 |
| 4,549,608 | A | 10/1985 | Stowe et al. | |
| 4,660,643 | A | 4/1987 | Perkins | |
| 4,798,244 | A * | 1/1989 | Trost | E21B 43/263 102/313 |
| 4,802,144 | A * | 1/1989 | Holzhausen | E21B 43/26 181/105 |
| 4,834,181 | A | 5/1989 | Uhri et al. | |
| 4,858,130 | A * | 8/1989 | Widrow | E21B 43/26 702/11 |
| 5,070,457 | A | 12/1991 | Poulsen | |
| 5,170,378 | A | 12/1992 | Mellor et al. | |
| 5,934,371 | A * | 8/1999 | Bussear | E21B 17/028 166/53 |
| 6,268,911 | B1 * | 7/2001 | Tubel | E21B 23/03 250/256 |
| 8,978,764 | B2 | 3/2015 | Dusseault et al. | |
| 2006/0201674 | A1 | 9/2006 | Soliman et al. | |
| 2007/0083331 | A1 * | 4/2007 | Craig | E21B 49/008 702/13 |
| 2010/0032156 | A1 * | 2/2010 | Petty | E21B 43/26 166/252.1 |
| 2012/0267096 | A1 | 10/2012 | Pershikova | |
| 2013/0197810 | A1 | 8/2013 | Haas et al. | |
| 2014/0058686 | A1 | 2/2014 | Anderson et al. | |
| 2014/0238668 | A1 | 8/2014 | Bittleston et al. | |
| 2014/0299318 | A1 | 10/2014 | Crews et al. | |
| 2015/0068746 | A1 | 3/2015 | Abass et al. | |
| 2015/0129211 | A1 | 5/2015 | Dusseault et al. | |

FOREIGN PATENT DOCUMENTS

| | | | | |
|---|---|---|---|---|
| EP | 2527586 | A1 | 11/2012 | |
| EP | 2700785 | A2 | 2/2014 | |
| GB | 2050467 | A | 1/1981 | |
| GB | 2231405 | A | 11/1990 | |
| WO | 2008004172 | A2 | 1/2008 | |
| WO | 2008093264 | A1 | 8/2008 | |
| WO | 2009086279 | A2 | 7/2009 | |
| WO | WO 2009086279 | A2 * | 7/2009 | E21B 33/124 |
| WO | 2012068397 | A2 | 5/2012 | |
| WO | 2014004611 | A2 | 1/2014 | |
| WO | 2014022587 | A2 | 2/2014 | |
| WO | 2014055273 | A1 | 4/2014 | |
| WO | 2016069114 | A1 | 5/2016 | |

OTHER PUBLICATIONS

EPO as Int'l Search Authority; Written Opinion of the Int'l Searching Authority for PCT/GB2016/051621; dated Sep. 12, 2016 (est.); entire document; Munich, Germany.
Intellectual Property Office of the UK Patent Office; Search Report for GB1509579.7; dated Sep. 14, 2015; entire document; United Kingdom.
EPO as Int'l Search Authority; International Search Report for PCT/GB2016/051625; dated Sep. 9, 2016; entire document; Rijswijk, The Netherlands.
EPO as Int'l Search Authority; Written Opinion of the Int'l Searching Authority for PCT/GB2016/051625; dated Sep. 9, 2016 (est.); entire document; Munich, Germany.
Intellectual Property Office of the UK Patent Office; Search Report for GB1513655.9; dated Jan. 31, 2016; entire document; United Kingdom.
Society of Petroleum Engineers; SPE 24824, "Fracture Measurement Using Hydraulic Impedance Testing"; Oct. 4-7, 1992; entire document; Washington, D.C., US.
Society of Petroleum Engineers; SPE/ISRM 47329, "Sand Production on Water Injectors: Just How Bad Can it Get?"; Jul. 8-10, 1996; entire document; Trondheim, Norway.
EPO as Int'l Search Authority; International Search Report for PCT/GB2016/051624; dated Sep. 9, 2016; entire document; Rijswijk, The Netherlands.
EPO as Int'l Search Authority; Written Opinion of the Int'l Searching Authority for PCT/GB2016/051624; dated Sep. 9, 2016 (est.); entire document; Munich, Germany.
Intellectual Property Office of the UK Patent Office; Search Report for GB1509576.3; dated Sep. 7, 2015; entire document; United Kingdom.

* cited by examiner

DOWNHOLE PRESSURE MEASURING TOOL WITH A HIGH SAMPLING RATE

The present invention relates to injecting fluids into wells and more particularly, to a system for dynamically monitoring injection operations on wells by determining the extent of fracturing using downhole pressure measurements.

While wells are commonly drilled for the production of fluids such as oil, gas and water, the reverse also occurs where fluids are injected into wells. Commonly referred to as injection wells, fluids such as water, wastewater, brine, chemicals and $CO_2$, are injected into porous rock formations underground. Injection wells have a range of uses including enhancing oil production, long term ($CO_2$) storage, waste disposal, mining, and preventing salt water intrusion.

When a fluid is injected into a well, it is always at a higher pressure than fluids in the formation and thus will permeate through the porous formation. Where man-made e.g. by perforation or natural fractures exist the fluids will enter the fractures and fill the volume of the fracture. If sufficient fluid pressure is used to shock the formation the natural fractures will dilate. Additionally, shearing occurs and the natural fractures can be made to extend in length. Fractures can also be created by generating tensile failure in the rock.

The creation and extension of fractures can be beneficial, for example, when stimulating shale in the recovery of hydrocarbons by hydraulic fracturing. Here the well can be considered as an injection well for the injection of fluids during the frac job. In a typical frac job, water or viscosified water in the form of a gel is injected at a pumping rate which is ramped up to shock the formation and open pre-existing natural fractures in the formation. At the highest pumping rate, a proppant is then added to the water, to fill the fractures. The pumped fluid used in the frac job is then back produced followed by hydrocarbon flow, with hydrocarbon production directly related to the surface area of the fractures.

However, for disposal wells the reverse is the case. In disposal wells industrial wastes such as unwanted and often hazardous by-products of the chemical industry are injected into deep wells. More recently, geologic sequestration of $CO_2$ has begun. In these wells, strict regulations exist to protect contamination of underground sources of drinking water e.g. an aquifer within the formation. These regulations are meant to ensure that injected fluids stay within the well and the intended injection zone. The creation or extension of fractures will increase the injection zone and risk providing a fracture network extending to an aquifer.

In pressure support wells for hydrocarbon recovery, water is injected to support pressure in the reservoir (also known as voidage replacement), displace oil from the reservoir, and sweep it towards a well. These wells may be water injection or produced water re-injection. The creation or extension of fractures can result in early water breakthrough at the producing wells, severely limiting the hydrocarbon production.

It would therefore be beneficial to dynamically monitor the extent of fractures during injection operations. Techniques have been developed to measure fracture length. Tiltmeter-fracture-mapping and microseismic-fracture-mapping provide direct far-field methods which require expensive instrumentation located, preferably in boreholes, around the well and provide results which are difficult to interpret. The interpretation takes time and thus dynamic monitoring in real time or near real time is not possible. Well testing, in the form of running instrumentation into the well, provides direct near-wellbore results but these are limited to fractures close to the wellbore and can have large uncertainties based on assumptions made and lack of pre-fracture well test data. They also require well intervention and thus prohibit dynamic monitoring during injection.

The most widely used techniques are indirect calculations from hydraulic fracture modelling of net pressures, pressure-transient-test analyses and production-data analyses. These have the limitations that the length is inferred, not measured and consequently estimates vary greatly depending on which model is used. History matching of well tests is known to lead to non unique sets of parameters, leaving the interpreter with the best choice according to his/her experience and therefore significant uncertainty.

A prior art technique based on pressure measurements is described in 'Fracture Measurement Using Hydraulic Impedance Testing', R. W. Paige, J. D. M. Roberts, L. R. Murray, D. W. Mellor, SPE 24824, presented at the $67^{th}$ Annual Technical Conference and Exhibition of the Society of Petroleum Engineers held in Washington, D.C., Oct. 4-7, 1992. This technique determines fracture dimensions by introducing a pressure pulse into a well and interpreting the resulting pressure trace. The method involves use of a pressure gauge mounted at the wellhead. A pressure pulse will reflect from the bottom of the well and the resulting reflection can be analysed. Where fractures exist, the reflected trace will decay more quickly as it is assumed that a pulse entering a fracture will decay to nothing and not be seen in the wellbore, for greater sized fractures the reflection coefficient moves to zero and no reflection occurs. Still greater fractures will give a reflected inverted peak. A major limitation to this measurement is in the number of reflections which occur as the pulse travels through the wellbore which makes interpretation difficult. Yet further it is typical that pre-fracture data is unavailable and thus assumptions are made which greatly affect the calculated result.

It is therefore an object of the present invention to provide a dynamic monitoring system to monitor injection operations on wells by determining the extent of fracturing which overcomes at least some of the disadvantages of the prior art.

According to a first aspect of the present invention there is provided a dynamic monitoring system, comprising a downhole pressure gauge, means to transmit data from the downhole pressure gauge to surface and a surface data acquisition unit wherein, on inducing a pressure change in a wellbore by an injection operation, the downhole pressure gauge records a pressure trace as data, the data is transmitted to surface at a first sampling frequency, the data is stored in the surface data acquisition unit and fracture length is calculated from the stored data.

In this way, the pressure trace recorded can include reflections of a pressure pulse from the tips of fractures i.e. the furthest extent of the fracture from the wellbore. By locating the pressure gauge downhole, reflections within the wellbore are omitted from the detected pressure trace as these occur before the pulse enters the fracture.

Preferably, the first sampling frequency is greater than 10 Hz. Current permanent downhole pressure gauges do not measure at sampling frequencies greater than 10 Hz. Permanent downhole pressure gauges exist primarily to measure pressure response to fluid flow in production wells. This is a quasi-static problem which does not vary very rapidly and thus sampling rates of less than 10 Hz and more typically less than 0.2 Hz are sufficient. Additionally, any higher sampling rate than 0.2 Hz would provide data storage problems as the data is recorded continuously over the life of the well. Indeed, in many cases the data is deleted to keep only hourly or daily records.

As the present invention wishes to dynamically monitor extent of fracturing, any frequency less than 10 Hz would be insufficient as at 10 Hz the wavelength of a pulse through water (assuming water injection) is 144 m (velocity of a pressure wave through water is approximately 1440 m/s). As the sampling rate needs to be around ten times higher than the distance being measured to provide sufficient resolution, a 10 Hz sampling rate would be used to detect fracture lengths of around 1 km. The application areas considered above would be ineffective if fractures had to be 1 km in length to be detected. More preferably, the first sampling frequency is greater than or equal to 100 Hz. This would measure fracture lengths around 70 to 100 m and be suitable for waste disposal, mature water injection and shale stimulation applications. Optionally, the first sampling frequency is greater than or equal to 1 kHz. This sampling rate detects fracture lengths of around 7 to 10 m and would be considered adequate for clean or early water injection.

Preferably, the sampling frequency can be selected by a user. In this way, the data sampling frequency can be chosen depending upon what results may be expected or the application. More preferably the sampling frequency is variable during operation. In this way, a trade-off between resolution of the pressure trace and data storage capacity can be made. Alternatively, the first sampling frequency is set high to determine initial fracture lengths at the start of an injection operation and then a second sampling frequency is set to better match the resolution required for the fracture lengths measured at the first sampling frequency. In this way, an initial pressure change can be induced in the well for the purposes of determining initial fracture lengths, further injection can then be undertaken at a sampling frequency matching the expected fracture extent to minimise the storage capacity required at the surface acquisition unit.

Preferably, the downhole pressure gauge provides an analogue signal. In this way, the sampling rate is not limited by the pressure gauge used. The downhole pressure gauge may be a quartz gauge as traditionally used in the oil and gas industry. Alternatively, other pressure transducers may be adapted for use downhole e.g. strain gauges.

Preferably, the dynamic monitoring system includes a port to digitize the analogue signal. The port may comprise any analogue to digital converter. The port operates at frequencies greater than 10 Hz. The port may be programmable from surface so that the frequency may be changed to match the first sampling frequency.

Preferably, the means to transmit the data to surface is a cable. The cable may be an electrical cable as is known in the art. However, such cables are limited to 100 Hz capacity. More preferably, the cable is an encapsulated fibre optic cable. Such a cable can carry a much higher transmission rate. Alternatively the means to transmit the data to surface may be by wireless communication as is known in the art.

Preferably, the surface data acquisition unit comprises a processor and a storage facility. The storage facility may be a memory. Preferably the processor includes means to vary the sampling frequency. The means to vary the sampling frequency may select data from the signal sent from downhole which is at a higher sampling frequency than a desired sampling frequency. In this way, the amount of data stored can be limited. Additionally this allows the downhole pressure gauge and port to be pre-set before installation so that signals can be continuously transmitted to surface and no control signals need to be sent downhole. Alternatively, the means to vary the sampling frequency may send a control signal down the cable to adjust the rate of the port. The surface data acquisition unit may also comprise transmission means to transmit data to a remote site for analysis.

Preferably the pressure change is induced in the wellbore by shut-in following injection. Preferably, shut-in is rapid so as to cause a hammer pressure wave. In this way, the reflection of this pressure wave in the formation provides the pressure trace. Preferably, the pressure trace is treated with a fast Fourier Transform. In this way, frequency components of the Transform can be interpreted in terms of the distance of the reflector i.e. tip of fracture, to the downhole pressure gauge, using the speed of sound in the aqueous fluid, to give distances equivalent to the lateral extension of the fractures.

Accordingly, the drawings and description are to be regarded as illustrative in nature and not as restrictive. Furthermore, the terminology and phraseology used herein is solely used for descriptive purposes and should not be construed as limiting in scope languages such as including, comprising, having, containing or involving and variations thereof is intended to be broad and encompass the subject matter listed thereafter, equivalents and additional subject matter not recited and is not intended to exclude other additives, components, integers or steps. Likewise, the term comprising, is considered synonymous with the terms including or containing for applicable legal purposes. Any discussion of documents, acts, materials, devices, articles and the like is included in the specification solely for the purpose of providing a context for the present invention. It is not suggested or represented that any or all of these matters form part of the prior art based on a common general knowledge in the field relevant to the present invention. All numerical values in the disclosure are understood as being modified by "about". All singular forms of elements or any other components described herein are understood to include plural forms thereof and vice versa.

While the specification will refer to up and down along with uppermost and lowermost, these are to be understood as relative terms in relation to a wellbore and that the inclination of the wellbore, although shown vertically in some Figures, may be inclined. This is known in the art of horizontal wells.

Embodiments of the present invention will now be described, by way of example only, with reference to the accompanying Figures, of which:

FIG. 2 is a graph of a pressure trace showing downhole pressure versus time at shut-in;

Figure 1:
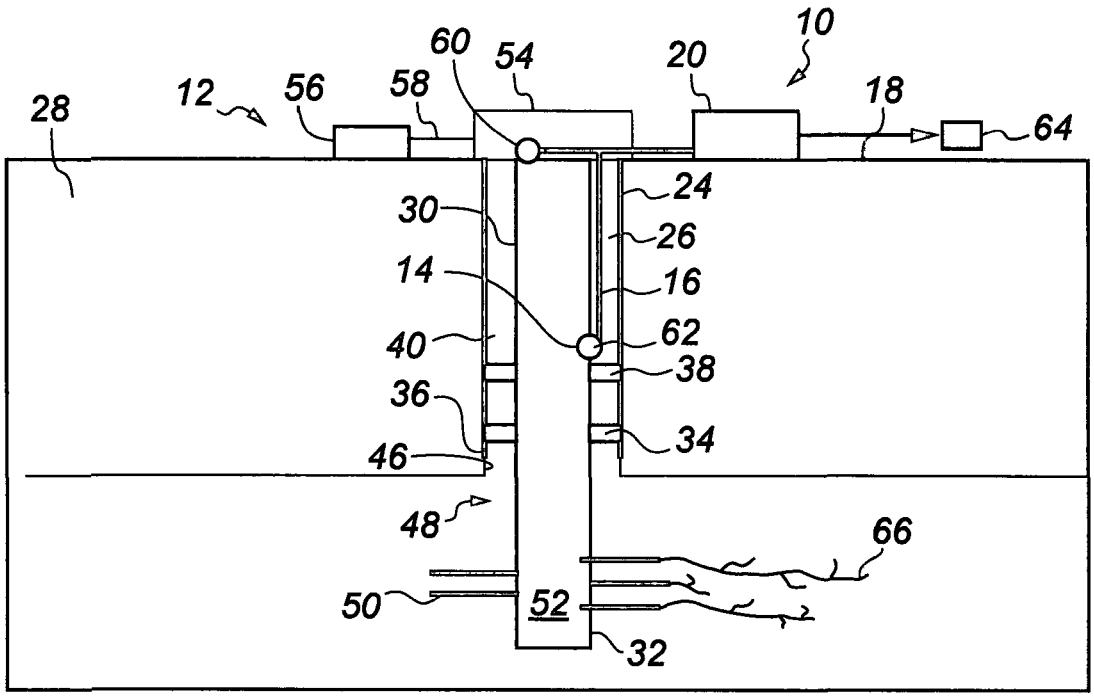
FIG. 1 is a schematic illustration of a well in which the system of the present invention is installed.

Referring initially to FIG. 1, there is shown a simplified illustration of an injection well as may be used for hydraulic fracturing of shale, for example. A dynamic monitoring system, generally indicated by reference numeral 10, is installed at the well 12. The dynamic monitoring system 10 comprises a downhole pressure gauge 14, a cable 16 to transmit data from the downhole pressure gauge 14 to surface 18 and a surface data acquisition unit 20.

In FIG. 1, the well 12 is shown as entirely vertical with a single formation interval 22, but it will be realised that the well 12 could be effectively horizontal in practise. Dimensions are also greatly altered to highlight the significant areas of interest. Well 12 is drilled in the traditional manner providing a casing 24 to support the borehole 26 through the length of the cap rock 28 to the location of the shale formation 22. Standard techniques known to those skilled in the art will have been used to identify the location of the shale formation 22 and to determine properties of the well 12.

Production tubing 30 is located through the casing 24 and tubing 32, in the form of a production liner, is hung from a liner hanger 34 at the base 36 of the production tubing 30 and extends into the borehole 26 through the shale formation 22. A production packer 38 provides a seal between the production tubing 30 and the casing 24, preventing the passage of fluids through the annulus 40 there-between. Cement is pumped into the annulus 42 between the outer surface 44 of the production liner 32 and in the inner wall 46 of the open borehole 26. This cement forms a cement sheath 48 in the annulus 42. When all in place, perforations 50 are created through the production liner 32 and the cement sheath 48 to expose the formation 22 to the inner conduit 52 of the production liner 32. All of this is performed as the standard technique for drilling and completing a well 12 in a shale formation 22. Natural fractures 66 can exist in the formation 22 or may have been created during injection through the perforations 50.

At surface 18, there is a standard wellhead 54. Wellhead 54 provides a conduit (not shown) for the passage of fluids such as hydrocarbons from the well 12. Wellhead 54 also provides a conduit 58 for the injection of fluids from pumps 56. Wellhead gauges 60 are located on the wellhead 54 and are controlled from the data acquisition unit 20 which also collects the data from the wellhead gauges 60. Wellhead gauges 60 include a temperature gauge, a pressure gauge and a rate gauge. All of these surface components are standard at a wellhead 54.

The dynamic monitoring system 10 includes a downhole pressure gauge 14. Downhole pressure gauges 14 are known in the industry and are run from unit 20 at surface 18, to above the production packer 38. The downhole pressure gauge 14 typically combines a downhole temperature and pressure gauge. The gauge 14 is mounted in a side pocket mandrel in the production tubing 30. In this way, the gauge 14 does not interfere with other tools etc passed down the production tubing 30. Data is transferred via a high capacity cable 16 located in the annulus 40. The gauge 14 may be a standard gauge though, for the present invention, the gauge 14 must be able to record downhole pressure data at a high acquisition rate. A quartz gauge can achieve this. The signal is recorded as an analogue signal and a port 62 provides an analogue to digital converter set at the desired acquisition rate. This acquisition rate can be considered as a sampling frequency. The sampling frequency can be set before the gauge 14 and port 62 are installed in the well 12 or a control signal can be sent from the unit 20 to the port 62 via the cable 16, to change the sampling frequency.

For the present invention, the sampling frequency must be greater than 10 Hz. Current downhole pressure gauges do not measure at sampling frequencies greater than 10 Hz. Retrievable memory gauges exist which provide a temperature and pressure gauge on a wireline which is run into the well 12 and recorded data stored in an on-board memory to be analysed later when the gauges are retrieved. The memory gauge sampling capacity is up to 10 Hz but more often 1 Hz is used as faster responses are not expected to be needed and memory storage capacity is limited. Permanent downhole pressure gauges also exist although these are primarily used to measure pressure response to fluid flow in production wells. This is a quasi-static problem which does not vary very rapidly and thus sampling rates of less than 10 Hz and more typically less than 0.2 Hz are sufficient. Additionally, any higher sampling rate than 0.2 Hz would provide data storage problems as the data is recorded continuously over the life of the well. Indeed, in many cases the data is deleted to keep only hourly or daily records.

As the present invention wishes to dynamically monitor extent of fracturing, any frequency less than 10 Hz would be insufficient as at 10 Hz the wavelength of a pulse through water (assuming water injection) is 144 m (velocity of a pressure wave through water is approximately 1440 m/s). If we consider that the fracture tip is a stiff reflector and that a pulse will travel through the fracture, be reflected at the tip and travel back to the pressure gauge 14 for recordal, this reflected signal is an indication of the time taken for a wave to travel from its source to the reflector and back. Simple theory states that this time $t=2D/V$, were D is the distance to the reflector and V is the velocity of propagation of a pressure wave through a fluid. With V taken as approximately 1440 m/s, D will then provide the length of a fracture. As the sampling rate needs to be around ten times higher than the distance being measured to provide sufficient resolution, a 10 Hz sampling rate would only be useful to detect distances of around 1 km. In the prior art, such a sampling rate used at a pressure gauge at the wellhead was sufficient to detect the reflection from the bottom of the borehole. However, for a downhole gauge, the fractures would have to be 1 km in length before they were detected. Clearly this is inappropriate for a dynamic monitoring system 10.

The sampling frequency is therefore selected to be 100 Hz or greater in an embodiment. This would measure fracture lengths around 70 to 100 m and be suitable for waste disposal, mature water injection and shale stimulation applications. In a further embodiment, the sampling frequency is 1 kHz or greater. This sampling rate detects fracture lengths of around 7 to 10 m and would be considered adequate for clean or early water injection.

Quartz pressure gauges exist which can be adapted for downhole use and provide the required signal detection rate. Other types of pressure gauges such as strain gauges could also be adapted for downhole use. The port 62 is an electronic PC board/microchip and such analogue to digital converters, at the desired sampling frequencies, are readily available in other technical fields. These can be adapted to operate downhole although operation at downhole temperatures needs consideration. Programmable analogue to digital converters are also available.

Traditional electric cables 16 are used to carry data from downhole to surface have a capacity of around 100 Hz. Other cables, such as encapsulated fibre optic, are now available which have a much higher data transmission rate. Alternatively, wireless telemetry systems could be used as long as they provide the data carrying capacity required.

At surface 18, the data is transferred to a data acquisition unit 20. The unit 20 can control multiple gauges used on the well 12. The unit 20 can also be used to coordinate when pressure traces are recorded on the gauge 14 to coincide with an injection operation by, for example, having control of pumps 56 or by detecting a change in rate at the wellhead gauges 60. Unit 20 will include a processor and a memory storage facility. Unit 20 will also have a transmitter and receiver so that control signals can be sent to the unit 20 from a remote control unit 64. Thus the data can be analysed remotely.

In use, the dynamic monitoring system 10 is installed on a well 12 The downhole pressure gauge 14 and port 62 are located near the bottom of the well 12 or at a location where fractures are intended e.g. at the production packer 38 with the perforations 50 below. While this is the arrangement for an injection well, being a shale well intended for hydraulic fracturing, the set-up is similar for any injection well such as a disposal well or a pressure support well, with the downhole pressure gauge located to obtain an equivalent bottom hole pressure. The downhole pressure gauge 14 is connected with the port 62 to surface 18, by a cable 16. These are permanent installations, preferably installed when the well 12 is completed. At surface 18, the cable 16 is connected to a data acquisition unit 20.

A pressure change is then induced in the borehole 26. This can be by injecting a test pressure pulse at a high rate or by injecting the required fluids for the intended injection operation. A test pressure pulse is as per the prior art. For this description we will use the preferred shut-in arrangement. Here a fluid such as water is injected into the well 12.

When a fluid is injected into a well 12, it is at a higher pressure than fluids in the formation 22 and thus it will permeate through the porous formation 22. Where man-made e.g. by injecting through perforations 50 or natural fractures 66 exist the fluids will enter the fractures and fill the volume of the fracture 66. If sufficient fluid pressure is used to shock the formation the natural fractures 66 will dilate. Additionally, shearing occurs and the natural fractures 66 can be made to extend in length. Fractures 66 can also be created by generating tensile failure in the rock which is influenced by temperature changes in the formation 22 during injection.

After either a test time, such as a cycle or after the injection process, the well 12 is shut-in. At shut-in the downhole pressure gauge 14 is continuously recording and the port 62 is preferably set to a high sampling frequency i.e. 1 kHz or greater. If the shut-in is done quickly, the graph of downhole pressure against time i.e. the pressure trace will show a water hammer pressure wave with peaks and troughs illustrating the reflections of the water hammer pressure wave from stiff reflectors in the formation 22. If the shut-in is slow then the hammer wave will be too truncated.

Figure 2:
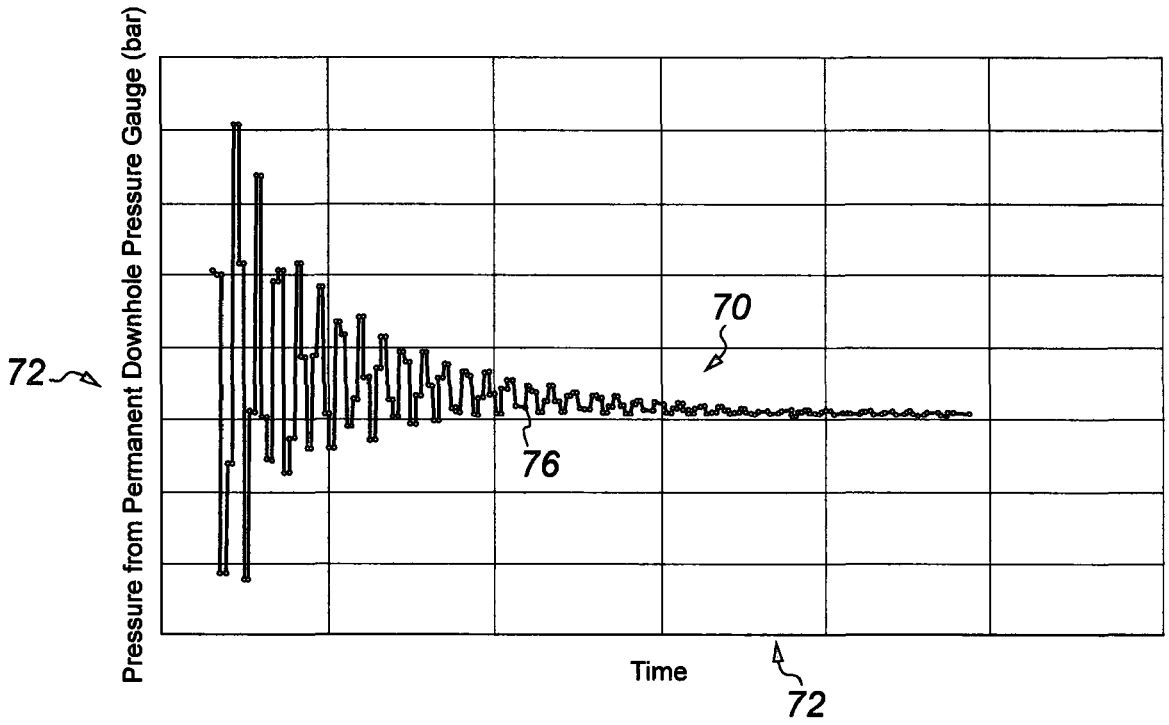

Reference is now made to FIG. 2 of the drawings which illustrates a pressure trace 70, recording downhole pressure 72 against time 74. Trace 70 is a characteristic decaying wave of peaks and troughs. The sampling frequency determines the number of data points on the graph and thus the resolution of the peaks and troughs. This wave 76 can be considered in the same way as a sound wave in active sonar. At shut-in, the 'ping' is created and the measured pressure trace represents the echo formed by reflections. By treating the wave 76 with a fast Fourier Transform, frequency components of the Transform can be identified.

Figure 3:
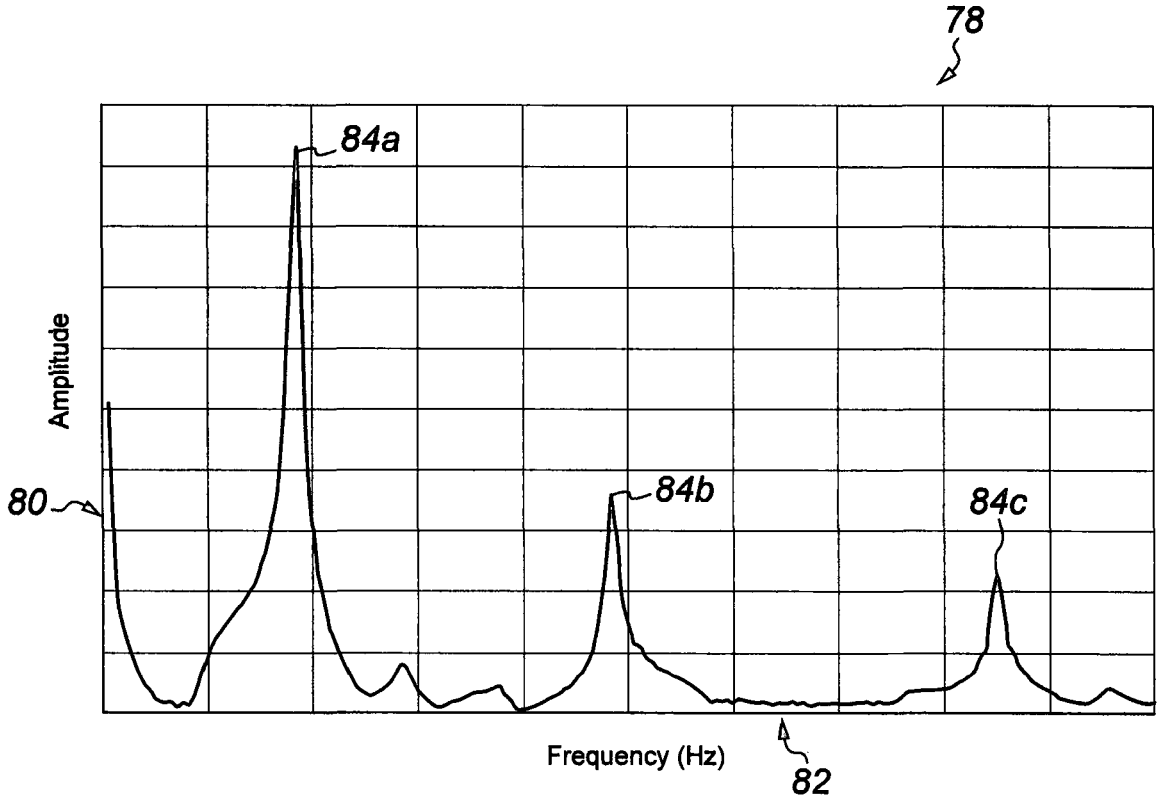
FIG. 3 is a Fourier Transform of the graph of FIG. 2 illustrating signals indicative of reflectors at distances from the wellbore.

FIG. 3, shows a Fourier Transform 78 of the wave 76 of FIG. 2. FIG. 3 is a Fourier spectral analysis providing amplitude 80 against frequency 82. The transform 78 shows three peaks 84*a-c*. Each peak 84 represents a reflection from a stiff reflector in the formation. This will be considered to be a reflection from the tip of a fracture 66. The frequency of each peak 84, provides a distance D, to the reflector by use of the equation, $1/f=4D/V$, were f is the frequency and V is the velocity of propagation of a pressure wave through a fluid. Here we use V as approximately 1440 m/s, being the velocity of a pressure wave through water, D will then provide the length of a fracture. Each peak 84*a-c* therefore correlates to a length of a fracture. The longest fracture lengths can then be considered to indicate the extent of fracturing in the well 12.

If further injection is to be carried out, the sampling frequency can now be varied to match the longest fracture lengths identified. In this way, the sampling frequency can be reduced, if possible, to allow for minimum data storage at the data acquisition unit. Alternatively, the first sampling frequency can be selected on the basis of well test data from other sources providing an expected fracture length.

For hydraulic fracturing in a shale formation, it is advantageous to have many peaks at shorter fracture lengths as this illustrates a high conductivity network from which hydrocarbon production can be obtained. Isolated peaks at greater fracture lengths can indicate a substantial fracture and well data should be consulted to determine what geological characteristics this could interfere with in the formation. If cyclic injection is being carried out, the fracturing job could be halted if the fracture length indicates a possible distance capable of accessing an aquifer.

Such peaks at greater than expected fracture lengths also indicate problems in waste disposal wells and pressure support wells. By dynamically monitoring the extent of fracturing, we can stop injection to prevent fractures extending into aquifers or creating early breakthough.

The system 10 is permanently mounted in the well and fracture length measurements can be made at any time. Shut-ins during any injection operation will generate a pressure trace and thus the growth of fractures during an injection operation can be measured and monitored in near real-time. Additionally, only a small amount of fluid is required to be injected into a well to provide a hammer pressure wave on shut-in, so the system 10 can be used across the lifetime of a well.

Figure 4:
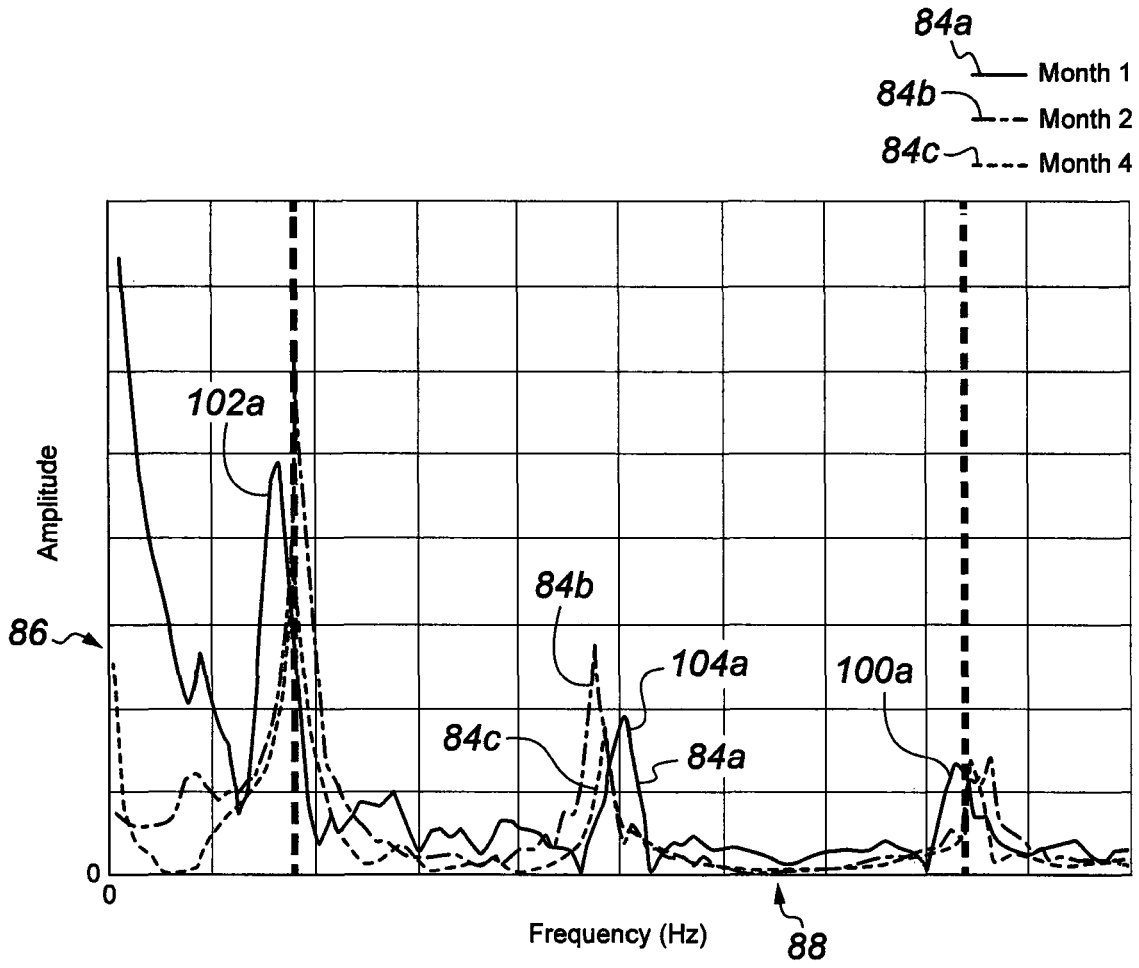
FIG. 4 is a graph of the Fourier Transform of pressure traces recorded over a period of months, taken from a wellbore.

Referring now to FIG. 4 of the drawings there is illustrated three plots of Fourier Transforms 84*a-c* of amplitude 86 versus frequency 88, for the same well at different time periods. Plot 84*a* is the Fourier Transform of a pressure trace from an initial shut-in, considered as Month 1. This has been taken on a fractured well, as an unfractured well would provide no data as the reflected wave would entirely cancel the propagating wave. The plot 84*a* provides limitations at each end of the graph. At the highest frequencies, shortest distances, we see a peak 100*a*, which represents the distance from the downhole pressure gauge 14 to the perforations 50, which are the first reflectors. At the lower frequencies at the start of the plot 84*a*, the peak 102*a* represents a reflection from the bottom of the well and which corresponds to the well length. Peaks 104*a* between peaks 100*a* and 102*a* are from reflections in the formation 22 indicating fractures 66, whose length can be calculated. If the data had been acquired at a higher frequency, we would see a greater number of peaks 104*a* between the outer peaks 100*a* and 102*a*.

Shut-in was repeated a month later and plot 84*b* is the resulting Fourier Transform of the pressure trace. The peaks are still present and any variation in amplitude is likely due to the resolution of data acquisition which was not high. After a four month period, the measurement was made again and plot 84*c* produced. Again the peaks are present and the Figure shows good reproducibility and a potential to determine if fracture length increases across each time period. The peaks 100,102 representing well length and distance to perforations may be used to add confidence to the measurements or provide a calibration, on which the sampling frequency can be selected.

The principle advantage of the present invention is that it provides a dynamic monitoring system for determining the extent of fracturing during injection operations on a well.

A further advantage of the present invention is that it provides a dynamic monitoring system which requires only replacement of existing components and thus is easily adopted.

A yet further advantage of the present invention is that it provides a dynamic monitoring system which can be used on any injection well.

Modifications may be made to the invention herein described without departing from the scope thereof. For example, it will be appreciated that some Figures are shown in an idealised form and that further interpretation of the graphs may be required. The velocity of propagation of a pressure wave in water has been estimated as 1440 m/s. Formulae exist to account for the elasticity of the medium containing the water which reduces this velocity. Such formulae could be used to provide a more complex model to calculate the extent of fracturing. Additionally, in the description herein we have considered a completion where the tubing is cemented in place providing a cement sheath which is perforated to expose the formation. Those skilled in the art will recognise that there are other completion methods available providing alternative ways of exposing the formation to the conduit of the tubing through which the injected fluid is delivered. External packers may also be deployed to isolate each interval and formation zone from its neighbours and techniques applied to inject into individual zones.

I claim:

1. A dynamic monitoring system, comprising a single permanent downhole pressure gauge, means to transmit data from the downhole pressure gauge to the surface and a surface data acquisition unit wherein, on inducing a pressure change in a wellbore by an injection operation, the downhole pressure gauge records a pressure trace as data, the data is transmitted to the surface at a first sampling frequency, the data is stored in the surface data acquisition unit and fracture length is calculated from the stored data; wherein the pressure trace is a graph of downhole pressure against time showing a water pressure hammer wave with peaks and troughs, the pressure trace is treated with a fast Fourier Transform to provide a graph of amplitude against frequency with one or more amplitude peaks, the frequency of each amplitude peak correlating to a length of a fracture.

2. The dynamic monitoring system according to claim 1 wherein the first sampling frequency is greater than 10 Hz.

3. The dynamic monitoring system according to claim 2 wherein the first sampling frequency is 100 Hz or greater.

4. The dynamic monitoring system according to claim 3 wherein the first sampling frequency is 1 kHz or greater.

5. The dynamic monitoring system according to claim 1 wherein the sampling frequency is variable during operation.

6. The dynamic monitoring system according to claim 5 wherein the sampling frequency is reduced from the first sampling frequency after the calculation of fracture length is made at the first sampling frequency.

7. The dynamic monitoring system according to claim 1 wherein the downhole pressure gauge provides an analogue signal.

8. The dynamic monitoring system according to claim 7 wherein the downhole pressure gauge is a quartz gauge.

9. The dynamic monitoring system according to claim 7 wherein the dynamic monitoring system includes a port to digitize the analogue signal.

10. The dynamic monitoring system according to claim 9 wherein the port comprises an analogue to digital converter.

11. The dynamic monitoring system according to claim 9 wherein the port operates at frequencies greater than 10 Hz.

12. The dynamic monitoring system according to claim 11 wherein the port is programmable from surface so that the frequency may be changed to match the first sampling frequency.

13. The dynamic monitoring system according to claim 1 wherein the means to transmit the data to surface is a cable.

14. The dynamic monitoring system according to claim 13 wherein the cable is an electrical cable.

15. The dynamic monitoring system according to claim 13 wherein the cable is an encapsulated fibre optic cable.

16. The dynamic monitoring system according to claim 1 wherein the surface data acquisition unit comprises a processor, a means to vary the sampling frequency and a storage facility.

17. The dynamic monitoring system according to claim 16 wherein the means to vary the sampling frequency selects a lower sampling frequency from the data sent from downhole transmitted at the first sampling frequency.

18. The dynamic monitoring system according to claim 16 wherein the means to vary the sampling frequency sends a control signal down a cable from the surface to adjust a rate of a port used to digitize an analogue signal from the downhole pressure gauge.

19. The dynamic monitoring system according to claim 1 wherein the pressure change is induced in the wellbore by shut-in following injection.

20. The dynamic monitoring system according to claim 1, wherein said single permanent downhole pressure gauge is located in a side pocket mandrel in a production tubing string.

* * * * *